US005742303A

United States Patent [19]

Taylor et al.

[11] Patent Number: 5,742,303

[45] Date of Patent: Apr. 21, 1998

[54] TRAP DOOR SPITTOON FOR INKJET AEROSOL MIST CONTROL

[75] Inventors: Bret K. Taylor; Mark S. Hickman, both of Vancouver, Wash.

[73] Assignee: Hewlett-Packard Company, Palo Alto, Calif.

[21] Appl. No.: 449,164

[22] Filed: May 24, 1995

[51] Int. Cl.[6] ..... B41J 2/165

[52] U.S. Cl. ..... 347/36; 347/35; 347/90

[58] Field of Search ..... 347/36, 30, 35, 347/29, 23, 22, 25, 26, 90

[56] References Cited

U.S. PATENT DOCUMENTS

| | | | |
|---|---|---|---|
| 3,981,020 | 9/1976 | Takano et al. | 346/75 |
| 4,668,959 | 5/1987 | Jochimsen et al. | 346/1.1 |
| 4,959,660 | 9/1990 | Suzuki et al. | 346/1.1 |
| 5,040,000 | 8/1991 | Yokoi | 347/30 |
| 5,155,497 | 10/1992 | Martin et al. | 346/1.1 |
| 5,270,738 | 12/1993 | Takahashi et al. | 346/140 |
| 5,477,256 | 12/1995 | Loyd et al. | 347/93 |
| 5,496,507 | 3/1996 | Angadjivand et al. | 264/423 |
| 5,563,639 | 10/1996 | Cameron et al. | 347/34 |

FOREIGN PATENT DOCUMENTS

| | | | |
|---|---|---|---|
| 0118216 A1 | 9/1984 | European Pat. Off. | H01G 7/02 |
| 0325854 A1 | 8/1989 | European Pat. Off. | B03C 3/28 |
| 0616831 A1 | 9/1994 | European Pat. Off. | B01D 39/16 |

*Primary Examiner*—John E. Barlow, Jr.
*Assistant Examiner*—Thien Tran
*Attorney, Agent, or Firm*—Flory L. Martin

[57] ABSTRACT

A trap door spittoon system confines airborne ink aerosol satellites generated while purging an inkjet printhead. This systems prevent stray ink aerosol from clinging to undesired surfaces in an inkjet printing mechanism. The printing mechanism has an inkjet printhead that selectively ejects ink during both printing and when purging the printhead by a process known as "spitting." This ink ejection generates as a by-product airborne ink aerosol satellites, which float about the mechanism, often landing in undesirable locations. To confine the ink aerosol generated during purging, the printing mechanism has a spittoon with a mouth that is covered by a trap door mechanism immediately following spitting to capture the stray aerosol within the spittoon. Various pivoting and sliding door embodiments are shown, along with a method of operating an inkjet printing mechanism to confine the wandering inkjet aerosol.

20 Claims, 4 Drawing Sheets

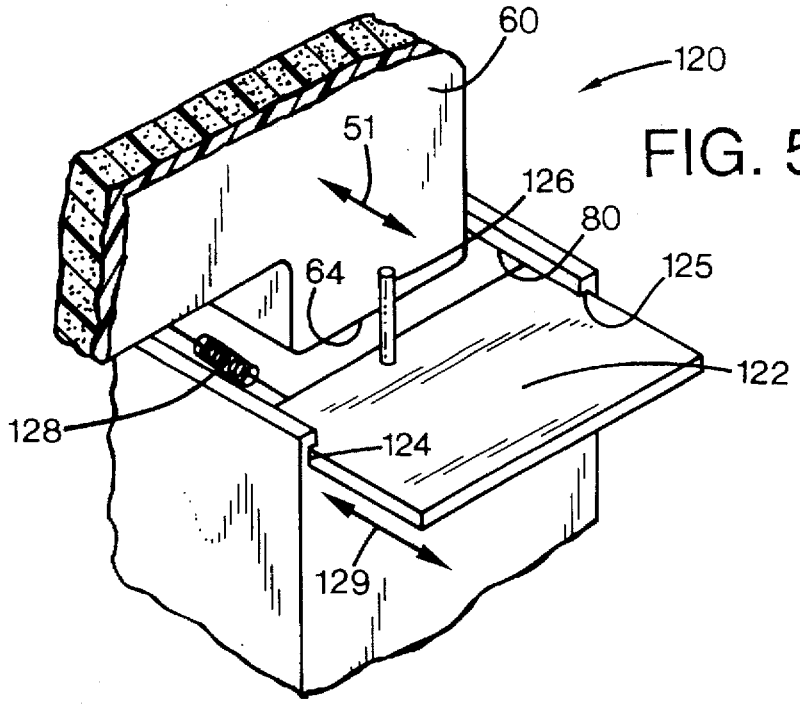
FIG. 5
FIG. 6
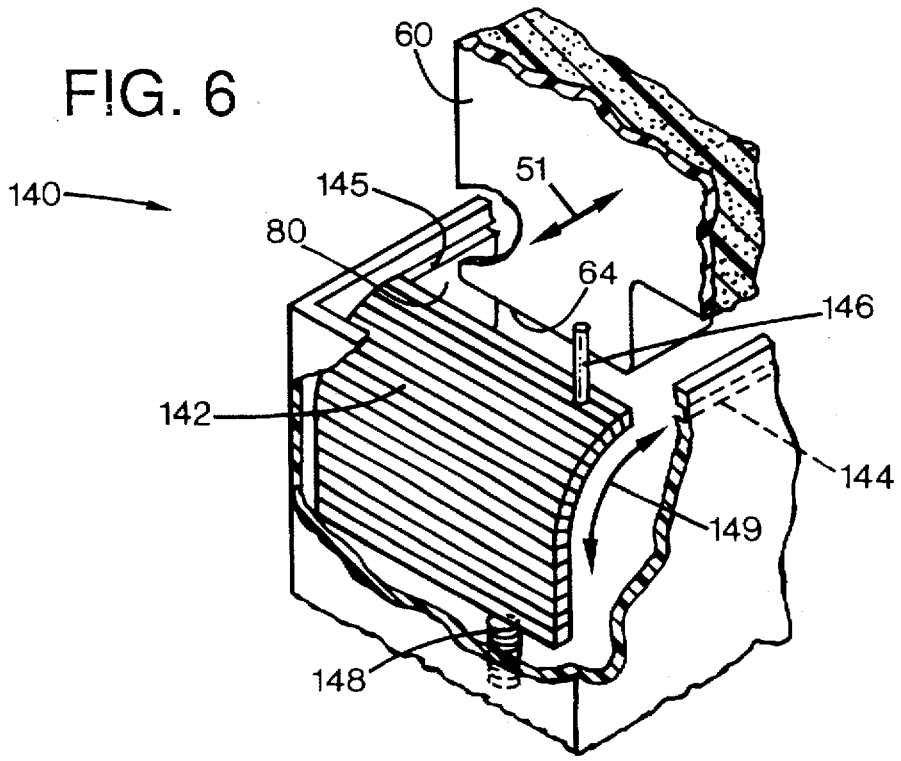

TRAP DOOR SPITTOON FOR INKJET AEROSOL MIST CONTROL

FIELD OF THE INVENTION

The present invention relates generally to inkjet printing mechanisms, and more particularly to a system that confines airborne ink aerosol satellites generated while purging an inkjet printhead to prevent the stray ink aerosol from clinging to other surfaces.

BACKGROUND OF THE INVENTION

Inkjet printing mechanisms use pens which shoot drops of liquid colorant, referred to generally herein as "ink," onto a page. Each pen has a printhead formed with very small nozzles through which the ink drops are fired. To print an image, the printhead is propelled back and forth across the page, shooting drops of ink in a desired pattern as it moves. The particular ink ejection mechanism within the printhead may take on a variety of different forms known to those skilled in the art, such as those using piezo-electric or thermal printhead technology. For instance, two earlier thermal ink ejection mechanisms are shown in U.S. Pat. Nos. 5,278,584 and 4,683,481, both assigned to the present assignee, Hewlett-Packard Company. In a thermal system, a barrier layer containing ink channels and vaporization chambers is located between a nozzle orifice plate and a substrate layer. This substrate layer typically contains linear arrays of heater elements, such as resistors, which are energized to heat ink within the vaporization chambers. Upon heating, an ink droplet is ejected from a nozzle associated with the energized resistor. By selectively energizing the resistors as the printhead moves across the page, the ink is expelled in a pattern on the print media to form a desired image (e.g., picture, chart or text).

To clean and protect the printhead, typically a "service station" mechanism is mounted within the printer chassis so the printhead can be moved over the station for maintenance. For storage, or during non-printing periods, the service stations usually include a capping system which hermetically seals the printhead nozzles from contaminants and drying. Some caps are also designed to facilitate priming, such as by being connected to a pumping unit that draws a vacuum on the printhead. During operation, clogs in the printhead are periodically cleared by firing a number of drops of ink through each of the nozzles in a process known as "spitting," with the waste ink being collected in a "spittoon" reservoir portion of the service station. After spitting, uncapping, or occasionally during printing, most service stations have an elastomeric wiper that wipes the printhead surface to remove ink residue, as well as any paper dust or other debris that has collected on the printhead.

To improve the clarity and contrast of the primed image, recent research has focused on improving the ink itself. To provide quicker, more waterfast printing with darker blacks and more vivid colors, pigment based inks have been developed. These pigment based inks have a higher solid content than the earlier dye based inks, which results in a higher optical density for the new inks. Both types of ink dry quickly, which allows inkjet printing mechanisms to use plain paper. Unfortunately, the combination of small nozzles and quick drying ink leaves the printheads susceptible to clogging, not only from dried ink and minute dust particles or paper fibers, but also from the solids within the new inks themselves. Partially or completely blocked nozzles can lead to either missing or misdirected drops on the print media, either of which degrades the print quality. Thus, spitting to clear the nozzles becomes even more important when using pigment based inks, because the higher solids content contributes to the clogging problem more than the earlier dye based inks.

Unfortunately, spitting, as well as printing, generates ink aerosol or satellites, which are about 0.1–5.0 micron-sized airborne ink particles that are generated every time the printhead ejects an ink droplet of a desired size for printing or spitting. Ink droplets larger than 5.0 microns usually impact in the desired location, either on the print media, or in the service station spittoon, rather than becoming airborne satellites. Since the new pigment based inks need more spitting than dye based inks to refresh the nozzles, due in part to the higher resolutions and the higher solids content, there are more opportunities to generate aerosol when using these new inks. Nonetheless, dye based inks have also been found to generate ink aerosol, including the color inks.

The small size and mass of these aerosol particles allows them to float in the air, migrating to settle in a variety of undesirable locations, including surfaces inside the printer. Motion of the printhead carriage generates air currents that may carry the ink aerosol onto critical components, such as the carriage position encoder optics, the encoder strip, or the printed circuit boards. Aerosol fogging of the optical encoder components may cause opacity, as well as light scattering or refraction, resulting in the loss of carriage position or velocity information. This migrating ink aerosol may also increase friction and cause corrosion of moving components, as well as degrading the life of critical components. For example, ink aerosol may accumulate along the printhead carriage guide rod, decreasing bushing life and increasing friction during normal operation. On the printed circuit boards, the ink aerosol may cause corrosion or electrical shorts.

In addition, this aerosol may settle on work surfaces near the printer, where it can then be transferred to an operator's fingers, clothing or other nearby objects. When the pen fires to print an image, many of these extraneous aerosol droplets land on the page, rather than floating around inside the printer. Unfortunately, these extraneous droplets may then degrade print quality. Efforts to improve reliability have also contributed to the aerosol problem. For example, low evaporation rate solvents have been employed to address the nozzle clogging problem discussed above. These solvents may cause the aerosol droplets to dry very slowly, if at all, once deposited inside the printer.

One method for controlling printhead generated ink aerosol addresses spit generated aerosol by using shallow spittoons. These shallow spittoons have surfaces closer to the printhead, which capture floating aerosol generated during spitting. Unfortunately, these shallow spittoon fill quickly with ink and clog, especially when using the high-solids low evaporable inks, such as the pigment based inks. Moreover, this system fails to control aerosol generated during printing.

SUMMARY OF THE INVENTION

One aspect of the invention an inkjet printing mechanism is provided. The mechanism comprises an inkjet printhead that selectively ejects ink, with the ink ejection generating airborne ink aerosol satellites. The printing mechanism also has a spittoon with a mouth that receives ink ejected from the printhead during purging. A door mechanism is attached to the spittoon to selectively open the spittoon mouth to receive purged ink and to close the spittoon mouth to confine airborne ink aerosol satellites within the spittoon after purging.

According to another aspect of the present invention, a method of operating an inkjet printing mechanism addresses the inkjet aerosol problem. The method includes the step of ejecting ink through an inkjet printhead to generate a desired ink droplet and a by-product comprising floating ink satellites. In a purging step, the printhead is purged by depositing the desired ink droplet in a spittoon of the printing mechanism. Following the purging step, a mouth of the spittoon is covered to capture least a portion of the floating ink satellites within the spittoon.

An overall object of the present invention is to provide an inkjet printing mechanism which prints sharp vivid images, particularly when using fast drying pigment or dye based inks.

A further object of the present invention is to provide a method of avoiding aerosol collection on surfaces of an inkjet printing mechanism.

Another object of the present invention is to provide an inkjet printing mechanism having cosmetic surfaces which stay clean to the sight and touch, even when printing with aerosol generating inkjet printheads which require frequent purging.

BRIEF DESCRIPTION OF THE DRAWINGS

FIGS. 3–6 are enlarged fragmented perspective views of alternate forms of trap door spittoons of the present invention, with FIGS. 3 and 4 showing pivoting embodiments, and FIGS. 5 and 6 showing sliding embodiments.

DETAILED DESCRIPTION OF THE PREFERRED EMBODIMENTS

Figure 1:
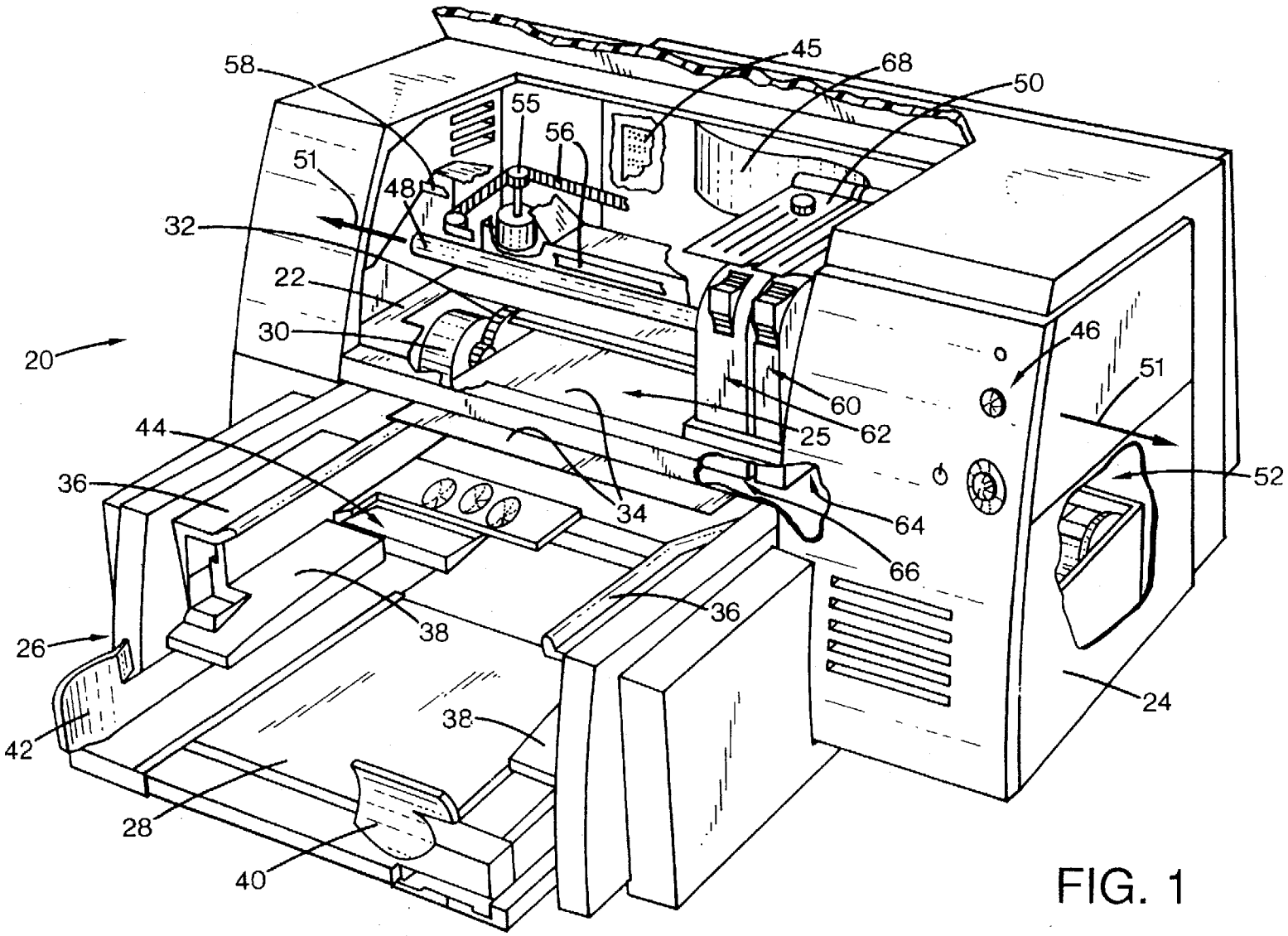
FIG. 1 is a fragmented, partially schematic, perspective view of one form of an inkjet printing mechanism of the present invention for managing inkjet aerosol.

FIG. 1 illustrates an embodiment of an inkjet printing mechanism, here shown as an inkjet printer 20, constructed in accordance with the present invention, which may be used for printing for business reports, correspondence, desktop publishing, and the like, in an industrial, office, home or other environment. A variety of inkjet printing mechanisms are commercially available. For instance, some of the printing mechanisms that may embody the present invention include plotters, portable printing units, copiers, cameras, video printers, and facsimile machines, to name a few. For convenience the concepts of the present invention are illustrated in the environment of an inkjet printer 20.

While it is apparent that the printer components may vary from model to model, the typical inkjet printer 20 includes a chassis 22 surrounded by a housing, casing or enclosure 24, typically of a plastic material. Sheets of print media are fed through a print zone 25 by a print media handling system 26. The print media may be any type of suitable sheet material, such as paper, card-stock, transparencies, mylar, and the like, but for convenience, the illustrated embodiment is described using paper as the print medium. The print media handling system 26 has a feed tray 28 for storing sheets of paper before printing. A series of conventional paper drive rollers (not shown), driven by a stepper motor 30 and drive gear assembly 32, may be used to move the print media from tray 28 into the print zone 25, as shown for sheet 34, for printing. After printing, the motor 30 drives the printed sheet 34 onto a pair of retractable output drying wing members 36. The wings 36 momentarily hold the newly printed sheet above any previously printed sheets still drying in an output tray portion 38 before retracting to the sides to drop the newly printed sheet into the output tray 38. The media handling system 26 may include a series of adjustment mechanisms for accommodating different sizes of print media, including letter, legal, A–4, envelopes, etc., such as a sliding length adjustment lever 40, a sliding width adjustment lever 42, and a sliding envelope feed plate 44.

The printer 20 also has a printer controller, illustrated schematically as a microprocessor 45, that receives instructions from a host device, typically a computer, such as a personal computer (not shown). The printer controller 45 may also operate in response to user inputs provided through a key pad 46 located on the exterior of the casing 24. A monitor attached to the computer host may be used to display visual information to an operator, such as the printer status or a particular program being run on the host computer. Personal computers, their input devices, such as a keyboard and/or a mouse device, and monitors are all well known to those skilled in the art.

A carriage guide rod 48 is supported by the chassis 22 to slideably support a dual inkjet pen carriage system 50 for travel back and forth across the print zone 25 along a scanning axis 51. The carriage 50 is also propelled along guide rod 48 into a servicing region, as indicated generally by arrow 52, located within the interior of the housing 24. One suitable type of carriage support system is shown in U.S. Pat. No. 5,366,305, assigned to Hewlett-Packard Company, the assignee of the present invention. A carriage drive gear and DC motor assembly 55 is attached to drive an endless belt 56. The motor 55 operates in response to control signals received from the controller 45. The belt 56 may be secured in a conventional manner to the carriage 50 to incrementally advance the carriage along guide rod 48 in response to rotation of motor 55.

To provide carriage positional feedback information to printer controller 45, an encoder strip 58 extends along the length of the print zone 25 and over the service station area 52. A conventional optical encoder reader may also be mounted on the back surface of printhead carriage 50 to read positional information provided by the encoder strip 58. The manner of attaching the belt 56 to the carriage, as well as the manner providing positional feedback information via the encoder strip reader, may be accomplished in a variety of different ways known to those skilled in the art. In the print zone 25, the media sheet 34 receives ink from an inkjet cartridge, such as a black ink cartridge 60 and/or a color ink cartridge 62. The cartridges 60 and 62 are also often called "pens" by those in the art. The illustrated color pen 62 is a tri-color pen, although in some embodiments, a set of discrete monochrome pens may be used. While the color pen 62 may contain a pigment based ink, for the purposes of illustration, pen 62 is described as containing three dye based ink colors, such as cyan, yellow and magenta. The black ink pen 60 is illustrated herein as containing a pigment based ink. It is apparent that other types of inks may also be used in pens 60, 62, such as paraffin based inks, as well as hybrid or composite inks having both dye and pigment characteristics.

The illustrated pens 60, 62 each include reservoirs for storing a supply of ink therein. The pens 60, 62 have printheads 64, 66 respectively, each of which have an orifice plate with a plurality of nozzles formed therethrough in a manner well known to those skilled in the art. The illustrated printheads 64, 66 are thermal inkjet printheads, although other types of printheads may be used, such as piezoelectric printheads. The printheads 64, 66 typically include a plurality of resistors which are associated with the nozzles. Upon energizing a selected resistor, a bubble of gas is formed ejecting a droplet of ink from the nozzle and onto a sheet of paper in the print zone 25 under the nozzle. The printhead resistors are selectively energized in response to firing command control signals delivered by a multiconductor strip 68 from the controller 45 to the printhead carriage 50.

Figure 2:
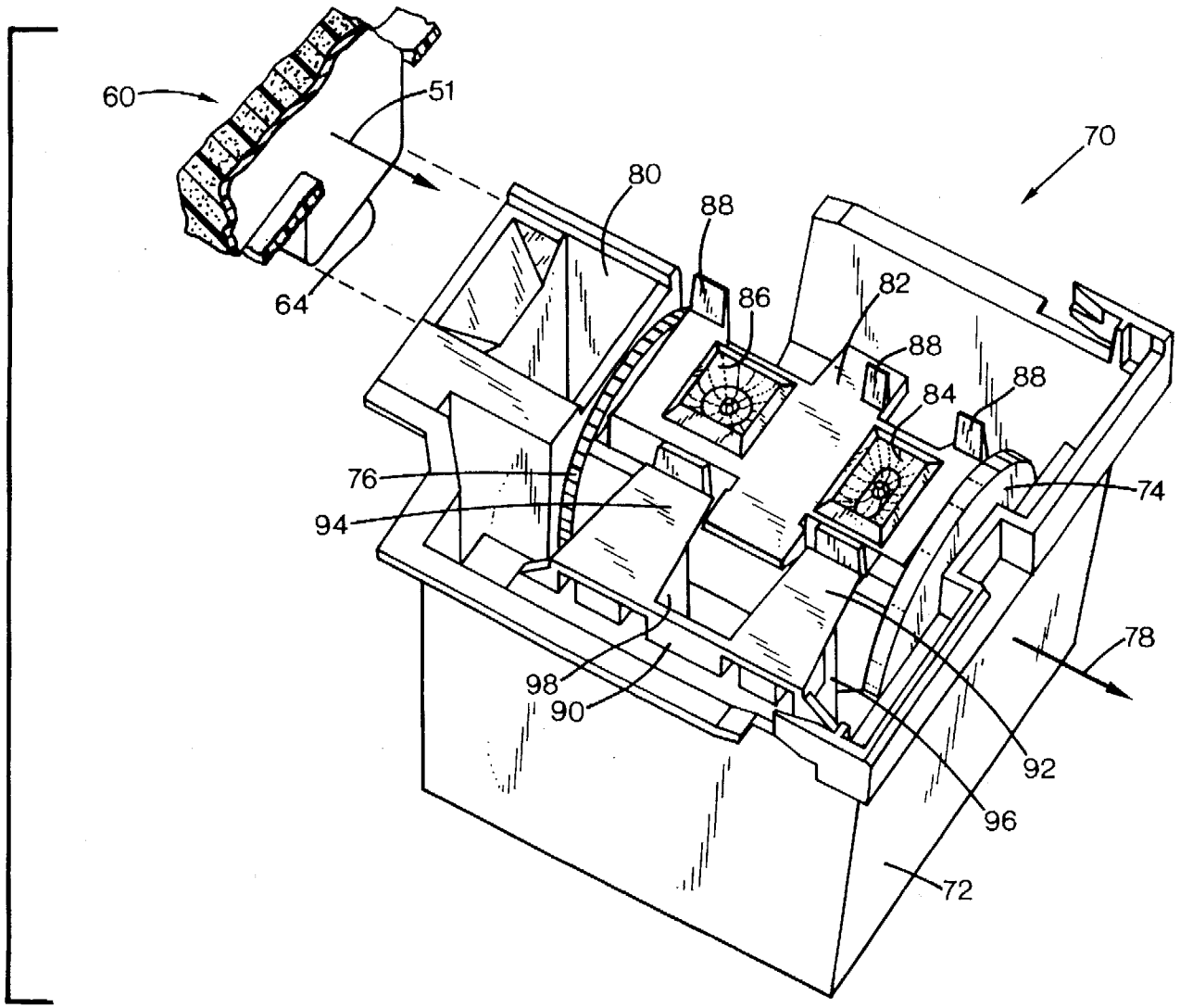
FIG. 2 is a fragmented perspective view of one form of a service station of FIG. 1 having a spittoon which may be fitted with a trap door mechanism of the present invention, such as those illustrated in FIGS. 3–6.

FIG. 2 illustrates one embodiment of a printhead service station 70 that resides within the servicing region 52 of the printer enclosure 24. The service station 70 includes a service station frame 72 that supports a rotary service station tumbler 74. The service station tumbler 74 may be driven by a conventional gear mechanism (not shown) which engages a drive gear 76 of the tumbler. The tumbler 74 rotates about an axis 78, which is substantially parallel to the carriage scanning axis 51. The service station 70 also includes a spittoon 80 which has an upper chimney portion with an opening or mouth portion that receives ink purged or "spit" from the printheads 64, 66.

In addition to the spitting function, the service station 70 also accommodates other printhead servicing functions, such as capping the printheads 64, 66 during periods of inactivity, wiping the printheads to remove accumulated waste ink and debris, and/or priming the printheads. These various servicing mechanisms may be located along the periphery of tumbler 74. Illustrative of these different servicing devices, the service station 70 is shown with a sled 82 in position to support black and color printhead priming caps 84, 86, which are used to prime the respective black and color printheads 64, 66. For instance, the priming sled 82 may have one or more upright arms 88, which are rotated through operation of gear 76 into contact with the printhead carriage 50 to bring the priming caps 84, 86 into contact with the printheads 64, 66 for priming.

The service station 70 also includes a blotting and scraping mechanism 90, which advantageously has two scrapper arms 92, 94 to clean printhead wipers located along another portion the tumbler 74. The assembly 90 also has a pair of blotter pads 96, 98 which engage the priming caps 84, 86 to blot them clean after a priming operation. It is apparent to those skilled in the art that a variety of other mechanisms may be used to provide the printhead servicing functions of priming, wiping and capping, in place of the tumbler mechanism 74 illustrated in FIG. 2. Indeed, a variety of different servicing mechanisms are installed in commercially available inkjet printing mechanisms, many of which may be suitably substituted for the servicing mechanism of tumbler 74.

Trap Door Spittoon Embodiments

Figure 3:
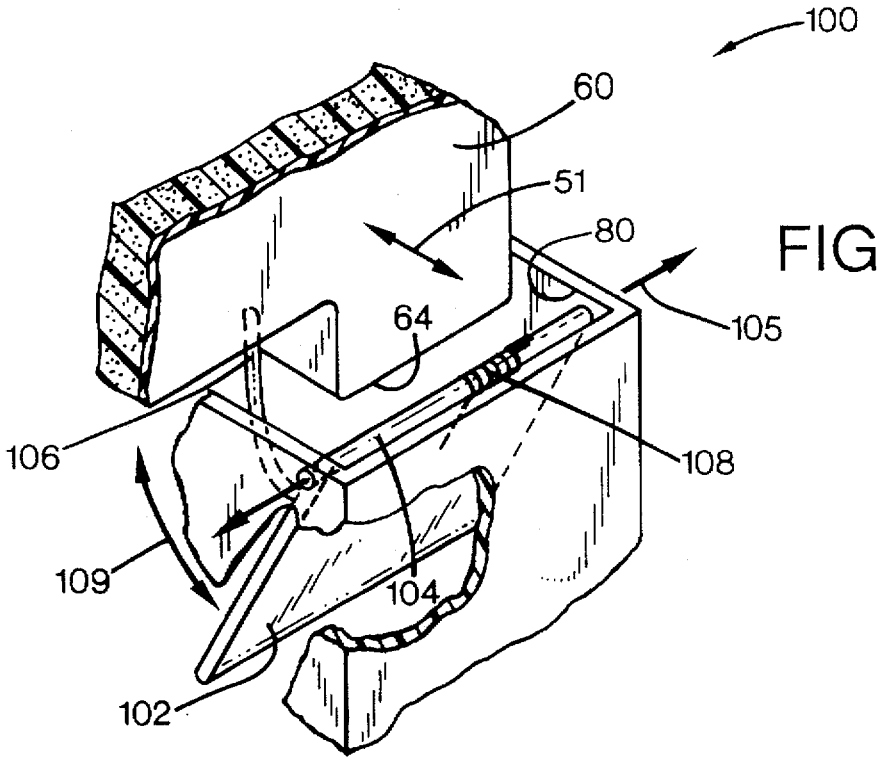

FIG. 3 illustrates a first embodiment of a trap door spittoon system 100 constructed in accordance with the present invention. Here, we see the chimney of spittoon 80 has been fitted with a trap door 102. The trap door 102 is pivoted to the spittoon by a hinge member 104 for rotation about a hinge axis 105. The trap door 102 has a contacting pin or actuator arm 106 which extends upwardly from the upper surface of door 102. The arm 106 is contacted by a portion of the pen 60, and/or the carriage 50 (not shown), as the carriage moves the pen along the scanning axis 51 into a spitting position over spittoon 80. Contact with arm 106 forces the trap door 102 downwardly to open the spittoon for receiving ink purged from the printheads 64, 66, although only pen 60 is shown in FIG. 3. When the pens 60, 62 leave the spittoon area 80, a biasing member, such as a torsional spring member 108 located along hinge 104, forces the door 102 into a closed position, as indicated by arrow 109. The closed door 102 contains at least a portion of the spit-generated within the spittoon 80.

Figure 4:
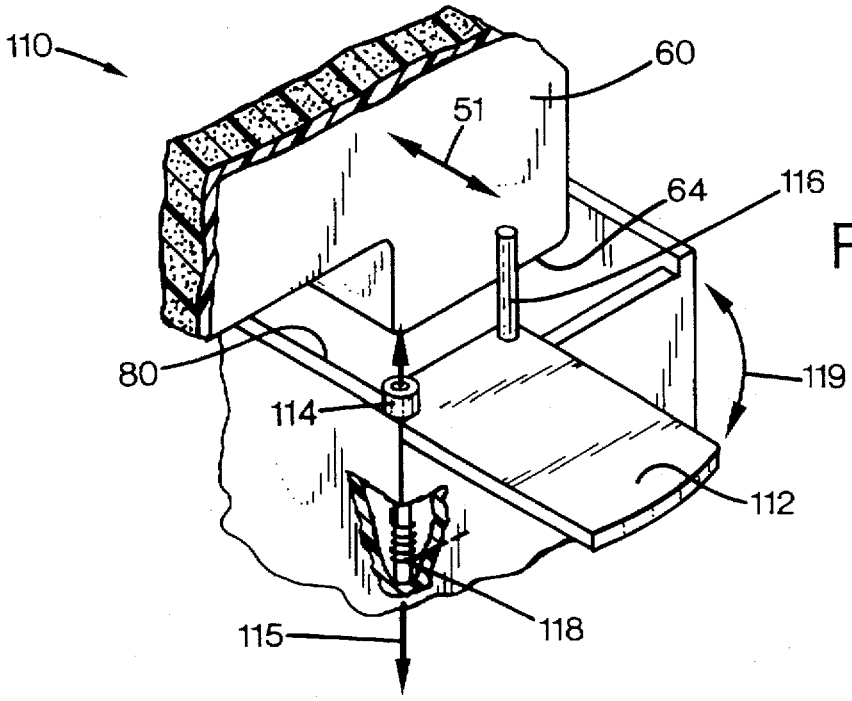

FIG. 4 illustrates a second embodiment of a trap door spittoon system 110 constructed in accordance with the present invention. In system 110, the spittoon 80 is covered by a trap door 112. The trap door 112 is pivotally attached to the chimney of spittoon 80 using a hinge member 114, which rotates about a hinge axis 115. In this embodiment, a contacting pin or actuating arm 116 extends upwardly from an upper surface of door 112 to contact either the pens 60, 62 or the carriage 50 (for clarity, only pen 60 is shown). As the pens 60, 62 move over the spittoon 80, the door 112 is rotated away from the upper portion of the spittoon, to allow the purged ink to be received through the spittoon chimney. Following the spitting operation, the carriage moves the pens 60, 62 from the spitting position, and door 112 is returned to cover the spittoon 80 under a biasing force provided by a bias member, such as a torsional spring member 118. Under the force of spring 118, the trap door 112 rotates, as indicated by arrow 119, to a closed position that traps ink aerosol satellites generated during purging inside the spittoon.

FIG. 5 shows a third embodiment of a trap door spittoon system 120 constructed in accordance with the present invention. In system 120, the spittoon 80 is covered by a sliding trap door 122. The trap door 122 rides in a pair of slots 124, 125 formed within the chimney walls of spittoon 80. The trap door 122 moves translationally to slide open when the pens 60, 62 and/or the carriage 50 engage a contact pin or actuating arm 126, although for clarity only pen 60 is shown engaging arm 126. After the spitting operation, the carriage moves the pens 60, 62 from the spitting position, and door 122 slides over the open spittoon mouth under the urging force of a bias member, such as a spring member 128. The spring 128 draws the door 122 back over the chimney entrance to isolate the floating ink aerosol satellites inside the spittoon, preventing their continued migration to undesirable surfaces both inside and outside the casing 24. Thus, in operation the door 122 slides translationally back and forth in directions indicated by arrow 129.

FIG. 6 shows a fourth embodiment of a trap door spittoon system 140 constructed in accordance with the present invention. In system 140, the spittoon 80 is covered by a sliding trap door 142. The trap door 142 rides in a pair of curved slots 144, 145 formed within the chimney walls of spittoon 80. The trap door 142 may be constructed of a flexible member, or a series of segments joined together to form a structure which functions in the manner of the traditional roll-top desk. The trap door 142 slides open when the pens 60, 62 and/or the carriage 50 engage a contact pin or actuating arm 146 (only pen 60 is shown for clarity). After the spitting operation, the carriage moves the pens 60, 62 from the spitting position, and the roll-top door 142 slides over the open spittoon mouth under the urging force of a bias member, such as a spring member 148. Thus, in operation the door 142 opens and closes the chimney mouth by sliding in directions indicated by arrow 149.

It is clear that other embodiments may be used to implement the concepts of the trap door spittoon system in accordance with the present invention, although the preferred alternative embodiments are illustrated. For instance, the pivoting trap doors 102, 112 are opened through pivoting action about either of two axes which are orthogonal to the scanning axis 51, here illustrated as located at axis 105 and axis 115, respectively. In the alternate sliding embodiments, the motion of the trap door 122 is parallel to the scanning axis 51, that is in the direction indicated by arrow 129 as the door slides open and closed. In contrast, the roll-top door 142 moves in directions both parallel and orthogonal to the scanning axis 51, as indicated by arrow 149. In another example, other trap door mechanism may be used in addition to the single trap doors illustrated, such as two door members, or multi-segmented doors, which may be arranged in an aperture configuration, for instance.

The spring 148 illustrates a compression spring, whereas the spring 128 of FIG. 5 is a tension spring. It is apparent to those skilled in the art, that a compression spring may also be employed in the straight sliding door system 120 of FIG. 5 to push, rather than pull door 122 closed, by merely changing the location of the spring with respect to the chimney walls. For example, the spring 128 shown in FIG. 5 may be replaced by a compression spring located between the trap door 122 and the opposite wall, that is the wall shown toward the right in FIG. 5. The same is true of the location of the spring force applied in the roll-top door system 140 of FIG. 6, which may pull, rather than push the door 142 closed. It is also apparent that other types of biasing mechanism may be substituted for the illustrated springs.

Indeed, the doors may be closed by movement of the carriage 50, through a camming engagement with the doors, for instance. In such an alternate embodiment, the actuating arms 106, 116, 126, 146 may act as cam followers to engage a cam structure on the carriage 50, or a cam structure may be formed on the doors 102, 112, 122, 142 and actuated by a cam follower on the carriage 50 to open and/or close the doors. It is also apparent that a separate motor may also be used to drive the trap doors, although the preferred embodiment is to have the carriage operate the doors.

By actuating the spittoon trap doors 102, 112, 122, 142 with the carriage 50, and/or the pens 60, 62, no additional mechanisms or servo motors are required to implement the preferred trap door system of aerosol control into currently available inkjet printing mechanisms. However, it is apparent that servo motors and the like may be incorporated into a printing mechanism if desired to open and close the trap doors 102, 112, 122, 142. For instance, such a servo mechanism or motor may operate the trap doors in response to a control signal sent by the printer controller 45, which receives positional information about the carriage 50, as described above with respect to the encoder strip 58. Indeed, operation of the tumbler 74 may be used to open and close the trap door, for example by locating a trap door actuator for selective engagement with a portion of the tumbler.

The instant closing of the spittoon doors 102, 112, 122, 142 as the printhead carriage 50 moves the pens 60, 62 away from the spittoon region advantageously traps any spit-generated ink aerosol within the spittoon 80. Capturing the airborne floating ink satellites within the enclosed region of spittoon 80 then isolates their further movement, and allows the aerosol to eventually collect and coalesce on the interior walls of the spittoon. Thus, this immediate capturing of the inkjet aerosol created during spitting advantageously isolates the aerosol from contaminating other components within the printer.

We claim:

1. An inkjet printing mechanism, comprising:

an inkjet printhead that selectively ejects ink, with ink ejection generating airborne ink aerosol satellites, said printhead movable within a printzone and a servicing region;

a spittoon, located in the servicing region, having a mouth to receive ink ejected from the printhead dining purging;

and a trap door member attached to the spittoon to selectively open the spittoon mouth in response to the printhead movement from the printzone to the servicing region to receive purged ink and to close the spittoon mouth to trap airborne ink aerosol satellites within the spittoon after purging.

2. An inkjet printing mechanism according to claim 1 wherein the trap door member is pivotally attached to the spittoon.

3. An inkjet printing mechanism according to claim 2 wherein:

the printing mechanism further includes a carriage that moves the inkjet printhead along a scanning axis across a printzone and over the spittoon; and the trap door member is pivotally attached to the spittoon for rotation around an axis orthogonal to the scanning axis.

4. An inkjet printing mechanism according to claim 3 wherein:

the scanning axis lies along a substantially horizontal plane; and the trap door member is pivotally attached to the spittoon for rotation around an axis lying in a substantially vertical plane.

5. An inkjet printing mechanism according to claim 3 wherein:

the scanning axis lies along a substantially horizontal plane; and the trap door member is pivotally attached to the spittoon for rotation around an axis lying in a substantially horizontal plane.

6. An inkjet printing mechanism according to claim 5 wherein the trap door member pivots into an interior portion of the spittoon to open the spittoon mouth.

7. An inkjet printing mechanism according to claim 1 wherein the trap door member is slideably attached to the spittoon.

8. An inkjet printing mechanism according to claim 7 wherein the trap door member is slideably attached to the spittoon to translationally open and close the spittoon mouth.

9. An inkjet printing mechanism according to claim 7 wherein:

the spittoon has a curved track; and the trap door member is slideably received within the curved track of the spittoon to open and close the spittoon mouth.

10. An inkjet printing mechanism according to claim 1 wherein:

the print mechanism further includes a carriage that moves the inkjet printhead across a printzone, and over the spittoon; and the trap door member retracts in response to the printhead movement into the interior portion of the spittoon to open the spittoon mouth.

11. An inkjet printing mechanism according to claim 1 wherein:

the printing mechanism further includes a carriage that moves the inkjet printhead across a printzone and over the spittoon; and the trap door member is opened in response to the printhead carriage movement.

12. An inkjet printing mechanism according to claim 11 further including a biasing member that operates to close the trap door member over the spittoon mouth.

13. An inkjet printing mechanism according to claim 1 wherein:

the print mechanism further includes a carriage that moves the inkjet printhead along a scanning axis across a printzone and over the spittoon; and the trap door member opens in response to the printhead movement and closes the spittoon mouth movement in a first plane substantially parallel to the scanning axis.

14. An inkjet printing mechanism according to claim 13 wherein the trap door member moves translationally in the first plane.

15. An inkjet printing mechanism according to claim 13 wherein the trap door member moves rotationally in the first plane.

16. A method of operating an inkjet printing mechanism, comprising the steps of:

uncovering a mouth of an ink spittoon with a trap door member in response to printhead carriage movement from a printzone into a servicing region;

ejecting ink through an inkjet printhead to generate a desired ink droplet and a by-product comprising floating ink satellites;

purging the printhead by depositing the desired ink droplet and at least some of the floating ink satellites in the spittoon; and following the purging step, covering the mouth of the spittoon by the trap door member to capture at least a portion of the floating ink satellites within the spittoon.

17. A method according to claim 16, further including the steps of:

moving the printhead adjacent the spittoon mouth prior to purging; and during the moving step, opening the mouth of the spittoon in response to the printhead movement.

18. A method according to claim 17, wherein the opening step comprises rotating a trap door pivoted to the spittoon to cover the mouth in the covering step.

19. A method according to claim 17, wherein the opening step comprises sliding a trap door slideably attached to the spittoon to cover the mouth in the covering step.

20. A method according to claim 17, wherein the opening step comprises moving a trap door attached to the spittoon into an interior portion of the spittoon.

* * * * *

UNITED STATES PATENT AND TRADEMARK OFFICE

CERTIFICATE OF CORRECTION

PATENT NO. : 5,742,303
DATED : April 21, 1998
INVENTOR(S) : Taylor et al.

It is certified that error appears in the above–identified patent and that said Letters Patent is hereby corrected as shown below:

Column 1 (line 53), delete "primed" and insert therefor -- printed --.

In the Claims

Column 8 (line 2), delete "dining" and insert ·rt therefor -- during --.

Signed and Sealed this
First Day of December, 1998

Bruce Lehman

*Attest:*

BRUCE LEHMAN

*Attesting Officer*

*Commissioner of Patents and Trademarks*